US006412900B2

(12) United States Patent
Horigome

(10) Patent No.: US 6,412,900 B2
(45) **Date of Patent: *Jul. 2, 2002**

(54) RECORDING APPARATUS HAVING A CHARGING FUNCTION, AND CHARGING METHOD

(75) Inventor: Hideo Horigome, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/190,093

(22) Filed: Nov. 12, 1998

(30) Foreign Application Priority Data

Nov. 14, 1997 (JP) ..... 9-313449

(51) Int. Cl.[7] ..... B41J 29/393
(52) U.S. Cl. ..... 347/19
(58) Field of Search ..... 347/19, 108, 5

(56) References Cited

U.S. PATENT DOCUMENTS

| | | | | |
|---|---|---|---|---|
| 4,313,124 A | | 1/1982 | Hara | 346/140 R |
| 4,345,262 A | | 8/1982 | Shirata et al. | 346/140 R |
| 4,459,600 A | | 7/1984 | Sato et al. | 346/140 R |
| 4,463,359 A | | 7/1984 | Ayata et al. | 346/1.1 |
| 4,558,333 A | | 12/1985 | Sugitani et al. | 346/140 R |
| 4,608,577 A | | 8/1986 | Hori | 346/140 R |
| 4,723,129 A | | 2/1988 | Endo et al. | 346/1.1 |
| 4,740,796 A | | 4/1988 | Endo et al. | 346/1.1 |
| 5,182,583 A | * | 1/1993 | Horigome et al. | 346/140 |
| 5,448,153 A | | 9/1995 | Ikeda et al. | 320/30 |
| 5,565,757 A | | 10/1996 | Ikeda et al. | 320/30 |
| 5,589,859 A | * | 12/1996 | Schantz | 347/19 |
| 5,631,677 A | * | 5/1997 | Horigome et al. | 347/19 |
| 5,631,766 A | | 5/1997 | Venhuizen et al. | 359/328 |
| 6,067,101 A | * | 5/2000 | Arakawa et al. | 347/19 |

FOREIGN PATENT DOCUMENTS

| | | | |
|---|---|---|---|
| EP | 0 642 925 | 3/1995 | |
| EP | 0 725 471 | 8/1996 | |
| JP | 54-56847 | 5/1979 | B41M/5/26 |
| JP | 59-123670 | 7/1984 | B41J/3/04 |
| JP | 59-138461 | 8/1984 | B41J/3/04 |
| JP | 60-71260 | 4/1985 | B41J/3/04 |
| JP | 10-217578 | 8/1998 | |

* cited by examiner

*Primary Examiner*—John Barlow
*Assistant Examiner*—Julian D. Huffman
(74) *Attorney, Agent, or Firm*—Fitzpatrick, Cella, Harper & Scinto

(57) ABSTRACT

In a recording apparatus, a charging function is turned on when it is detected that a recording head is capped. It is thereby possible to automatically prevent charging during periods in recording processing when a motor and the recording head are driven.

13 Claims, 3 Drawing Sheets

RECORDING APPARATUS HAVING A CHARGING FUNCTION, AND CHARGING METHOD

BACKGROUND OF THE INVENTION

1. Field of the Invention

The present invention relates to a recording apparatus capable of being driven by a rechargeable battery.

2. Description of the Related Art

In recording apparatuses, such as printers, facsimile apparatuses and the like, an image comprising a dot pattern is recorded on a recording sheet, such as paper, a plastic film or the like, by driving an energy generating member of a recording head based on image information.

The recording apparatuses are classified into ink-jet apparatuses, wire-dot apparatuses, thermal apparatuses and the like according to their respective recording methods. In ink-jet recording apparatuses, recording is performed by discharging droplets of a recording liquid (ink) from discharging ports of a recording head and causing the discharged droplets to adhere to a recording material, such as paper or the like.

So-called bubble-jet-type ink-jet recording heads which utilize heat energy for discharging ink droplets have the advantage that a small-size head can be easily obtained because discharging ports can be arranged at a high density. Hence, heads of this type are most suitable for portable small-sized recording apparatuses.

Although recording apparatuses ordinarily use an AC power supply as their main power supply, portable small-sized recording apparatuses use, in some cases, two power supplies, i.e., an AC adapter and a rechargeable battery.

When powering a recording apparatus with a battery, since the output voltage of the battery decreases as the remaining capacity of the battery decreases, it can become difficult to drive respective units of the apparatus. For example, if the apparatus suddenly stops during a recording operation, received recording information may be lost. In the case of an ink-jet recording apparatus, ink discharging ports of the recording head may not be closed by a capping member.

Accordingly, when powering a recording apparatus with a battery, particularly an ink-jet recording apparatus, it is necessary to provide means for charging a rechargeable battery when the capacity of the battery decreases to a value less than a predetermined value.

In conventional recording apparatuses having a rechargeable battery and a battery charging function, the operational mode of the apparatus is manually switched between a printing mode, i.e., an ordinary recording mode, and a battery charging mode.

However, configurations requiring manual switching between the printing mode and the charging mode require a troublesome manual operation, resulting in an inefficient use of the apparatus.

If recording processing and charging processing are performed in parallel, the apparatus can be efficiently used because it is unnecessary to perform a manual switching operation. However, this approach requires a large-capacity battery which allows parallel execution of recording processing and charging processing, resulting in an increase in the size and the cost of the recording apparatus.

Further, in this type of recording apparatus, the voltage and the charging current of the battery are typically detected during charging by performing analog-to-digital conversion by detecting, for example, a fully charged state or the like. However, when driving a motor and a print head during recording processing, the ground level of a signal fluctuates due to the relatively high driving current required by these components. If an analog-to-digital conversion circuit is operated in this state, the resulting accuracy of conversion decreases, which can cause unstable charging control.

In order to solve such problems, an approach may be considered in which current consumption in the apparatus is detected and charging is automatically performed only while the value of the detected current consumption is less than a predetermined value. However, for that purpose, it is necessary to provide means for very precisely detecting current consumption in the apparatus, resulting in an increase in the size and the cost of the apparatus. Furthermore, due to a voltage drop caused by a current-sensing resistor, the battery voltage will drop below a minimum useful value at an earlier stage, resulting in a shortened battery operating time period per charging operation.

SUMMARY OF THE INVENTION

It is an object of the present invention to provide a recording apparatus having a function of charging a battery with an improved operability without increasing the size and the cost of the apparatus, and a method for charging the battery.

It is another object of the present invention to provide a recording apparatus having a battery charging function in which the operational mode of the apparatus can be automatically switched between a printing mode and a charging mode.

One aspect of the present invention relates to a recording apparatus for performing recording by driving a recording head using electric power supplied from an external power supply or a battery. The recording apparatus includes a charging circuit for charging the battery using the electric power supplied from the external power supply, and control means for controlling the charging circuit based on retraction information indicating whether or not the recording head is at a retracted position where recording is not performed.

Another aspect of the present invention relates to a method for charging a recording apparatus which performs recording by driving a recording head using electric power supplied from an external power supply or a battery, and which includes a charging circuit for charging the battery using the electric power supplied from the external power supply. The method includes a control step of controlling the charging circuit based on a result of detecting whether or not the recording head is at a retracted position.

Another aspect of the present invention relates to a recording apparatus that includes a recording head, a power supply circuit, and a control circuit. The power supply circuit is capable of supplying power to the recording apparatus when external power is provided to the power supply, and is also capable of supplying power to the recording apparatus when power is provided to the power supply from a battery. The charging circuit charges the battery from the external power only when the recording head is capped, and inhibits charging of the battery when the recording head is uncapped.

According to configurations of the present invention described herein, it is possible to interrupt charging while a motor and the recording head are driven, and thereby improve the operability of the apparatus.

The foregoing and other objects, advantages and features of the present invention will become more apparent from the following detailed description of the preferred embodiment taken in conjunction with the accompanying drawings.

DETAILED DESCRIPTION OF THE PREFERRED EMBODIMENT

An ink-jet recording apparatus according to an embodiment of the present invention will now be described in detail with reference to the drawings.

Figure 1:
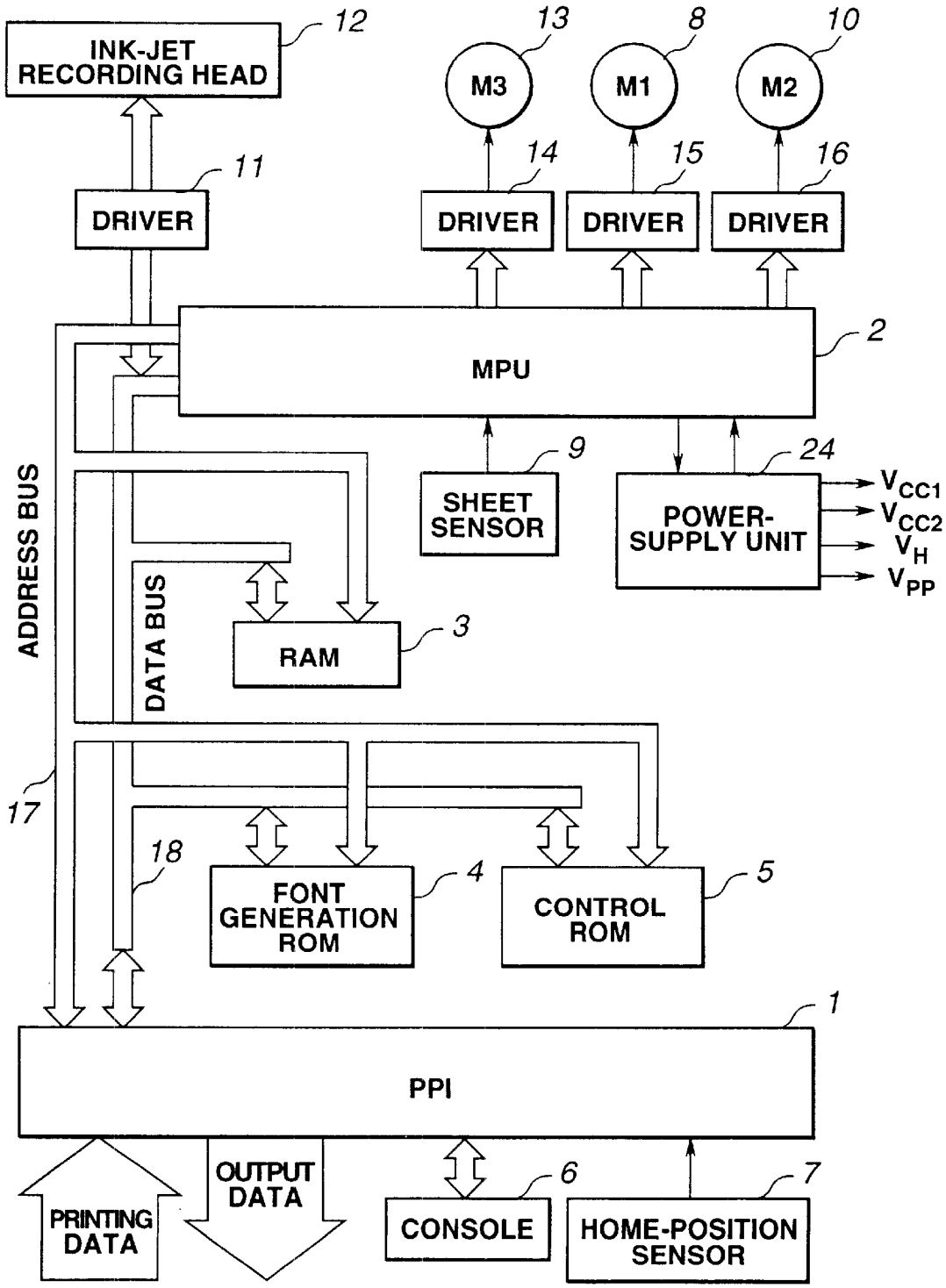
FIG. 1 is a block diagram illustrating the configuration of a control system of an ink-jet recording apparatus according to an embodiment of the present invention.

FIG. 1 is a block diagram illustrating the configuration of a control system of the ink-jet recording apparatus of the embodiment.

In FIG. 1, a programmable peripheral interface (hereinafter abbreviated as a "PPI") 1 performs parallel reception of an instruction signal (a command) and a recording-information signal transmitted from a host computer, and transfers the received signals to an MPU (microprocessing unit) 2. The PPI 1 also controls a console 6, and performs input processing for a carriage-home-position sensor 7.

The MPU 2 controls respective units within the recording apparatus. A RAM (random access memory) 3 is used as a reception buffer storage for storing received signals and a printing buffer storage for storing recording data. A font generation ROM (read-only memory) 4 outputs an image comprising characters and the like to be recorded. A control ROM 5 stores processing to be executed by the MPU 2 (see FIG. 3). These units are controlled via an address bus 17 and a data bus 18.

A carriage motor 8 moves a carriage. A sheet feeding motor 10 conveys a recording material in a direction perpendicular to the moving direction of the carriage. A capping motor 13 drives a capping member (cap, not shown) so as to contact ink discharging ports (not shown) of a recording head 12 (to be described later) and thereby to block the ink discharging ports from the external atmosphere. A driver 15 drives the carriage motor 8. A driver 16 drives the sheet feeding motor 10. A driver 14 drives the capping motor 13. The motors 8, 10 and 13 are controlled by the MPU 2, which always keeps track of the state of the motors 8, 10 and 13. For example, the MPU 2 keeps track of whether the cap is opened or closed by controlling the operation of the capping motor 13.

The console 6 includes keyboard switches, display lamps and the like.

The home-position sensor 7 is provided in the vicinity of the home position of the carriage in order to detect arrival of the carriage (upon which the recording head 12 is mounted) at the home position. A sheet sensor 9 detects whether or not a recording material, such as recording paper or the like, is present, i.e., whether or not the recording material is supplied to a recording portion.

The recording head 12 is a bubble-jet-type ink-jet recording head, which includes discharging ports (not shown), heaters for discharge (not shown) and the like. A driver 11 drives the heaters for discharge of the recording head 12 in accordance with recording data stored in the printing buffer storage of the RAM 3.

A power supply unit 24 supplies the above-described respective units with electric power, and preferably includes an AC adapter and a rechargeable battery as power supplies for driving the units.

In the above-described configuration, the MPU 2 is connected to a host apparatus, such as a computer or the like, via the PPI 1, and controls a recording operation based on commands and recording-information signals transmitted from the host apparatus, processing procedures of a program stored in the control ROM 5, and recording data stored in the RAM 3.

Figure 2:
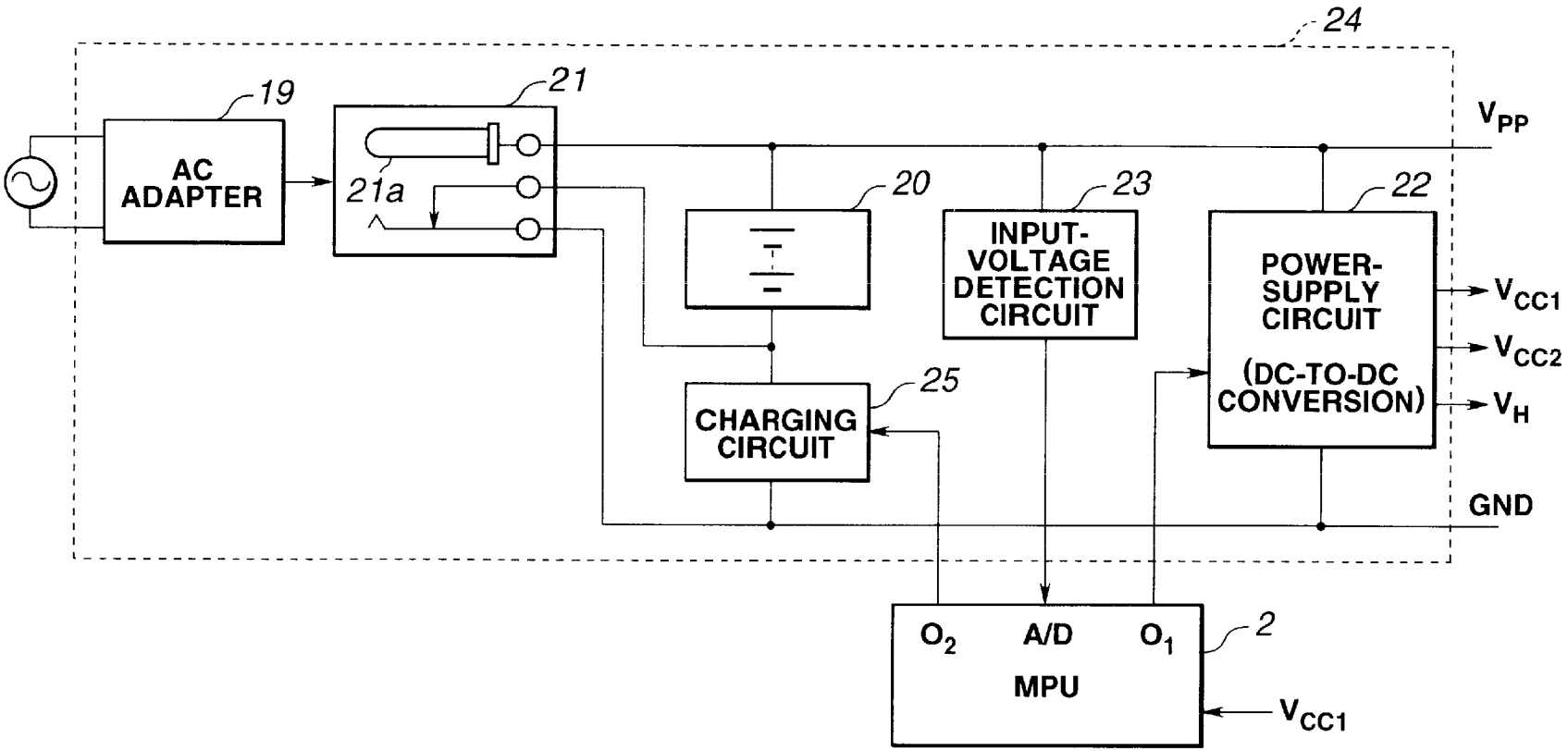
FIG. 2 is a block diagram illustrating a power-supply unit of the recording apparatus shown in FIG. 1.

Next, a description will be provided of the detail of the power-supply unit 24 with reference to the block diagram shown in FIG. 2. In FIG. 2, an AC adapter 19 and a rechargeable battery 20 serve as power supplies for driving the ink-jet recording apparatus. A source switcher 21 selects one of the above-described two power supplies, and preferably comprises a DC jack. When the DC plug of the AC adapter 19 is inserted into the DC jack 21, a contact 21*a* is opened, so that electric power is supplied from the AC adapter 19. When the DC plug of the AC adapter 19 is not inserted, the contact 21*a* is closed, so that the negative electrode of the battery 20 is connected to the ground GND and electric power from the battery 20 is supplied.

An input-voltage detection circuit 23 detects the output voltage of the supplied electric power, and transmits an output signal to an input A/D port of the MPU 2. In this embodiment, a simple input-voltage detection circuit 23, comprising a resistive voltage divider is used to generate a signal representing the detected voltage, which is input to the MPU 2. However, any other appropriate method, such as a method using an A/D converter or a method using a comparator, may also be considered. The MPU 2 which has received the output signal from the input-voltage detection circuit 23 at the A/D port can determine whether the supplied electric power is arriving from the AC adapter 19 or from the rechargeable battery 20 by recognizing the input voltage. This determination is performed based on the fact that the voltage from the AC adapter 19 is slightly higher than the voltage from the battery 20.

A power-supply circuit 22 converts the DC output from the power source into a voltage suitable for driving the respective units of the ink-jet recording apparatus under control via an output port O1 of the MPU 2. A logic voltage Vcc1 is also supplied to the MPU 2, and is supplied even in a power-off mode. A logic voltage Vcc2 and a head voltage VH are supplied to logic units other than the MPU 2, such as the RAM 3 and the like, and to the recording head 12, respectively, and are supplied only in an power-on mode (i.e., a state of recording or awaiting recording). The motor voltage Vpp is supplied to the motors 8, 10 and 13 (shown in FIG. 1).

A charging circuit 25 charges the rechargeable battery 20 under control via an output port O2 of the MPU 2. When the DC plug of the AC adapter 19 is detached, the charging circuit 25 is short-circuited because the contact 21*a* is closed.

A description will now be provided of control procedures by software for automatically switching the operating mode between a printing mode and a charging mode of charging the rechargeable battery 20 in the ink-jet recording apparatus having the above-described configuration.

Figure 3:
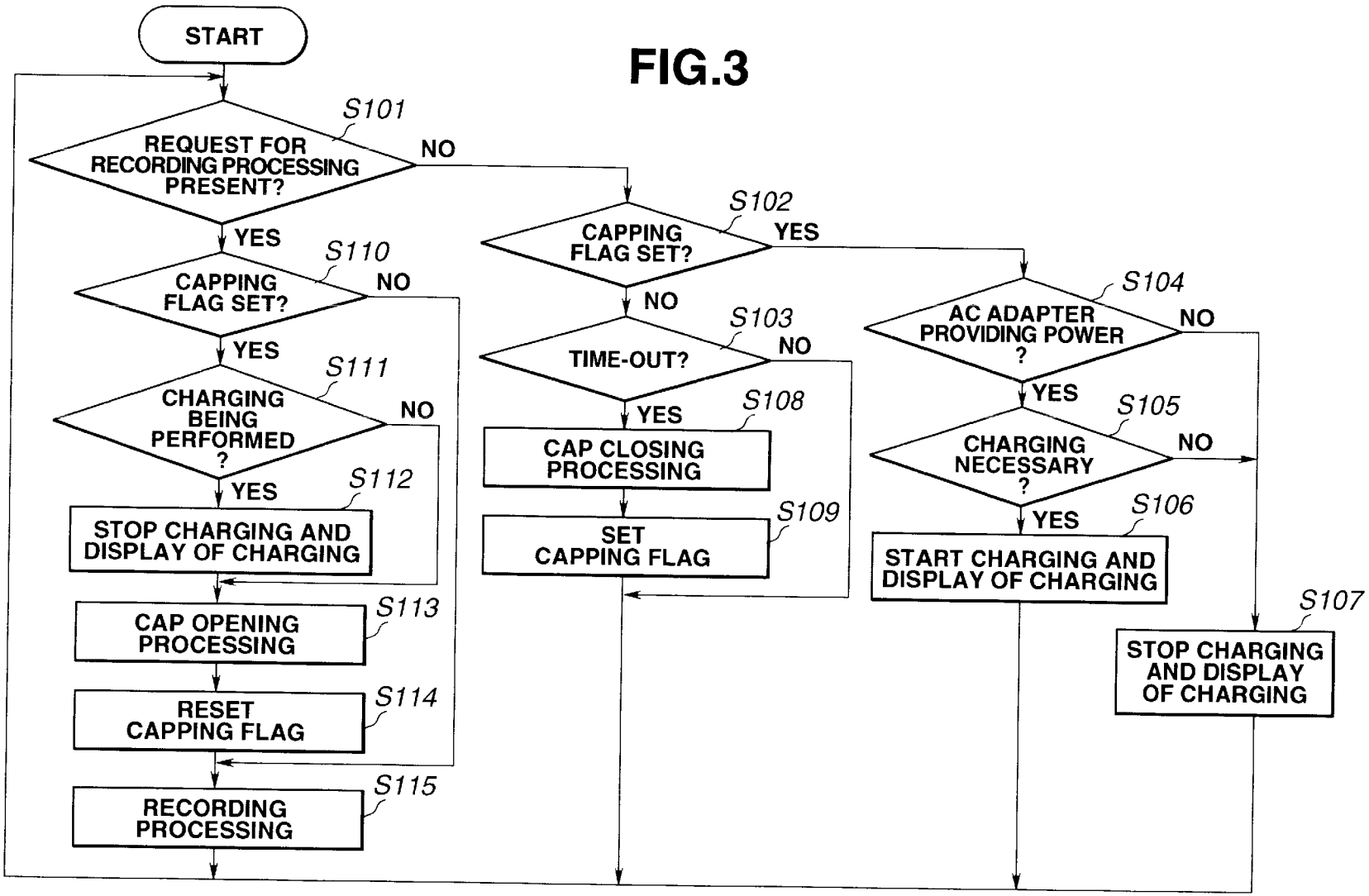
FIG. 3 is a flowchart illustrating charging procedures of the recording apparatus shown in FIG. 1.

FIG. 3 is a flowchart illustrating charging procedures by the MPU 2 of the recording apparatus of the embodiment. In FIG. 3, when the recording apparatus is started, it is determined in step S101 if a recording command from the host apparatus is present. If the result of the determination is negative, the process proceeds to step S102, where it is determined if the recording head is capped. This determination is performed by checking the capping flag (which is turned on/off by the MPU 2 because the MPU 2 controls the capping motor 13 as described above). If the result of the determination in step S102 is negative, i.e,, when the cap is opened, the process proceeds to step S103. If the result of the determination in step S102 is affirmative, i.e., when the cap is closed, the process proceeds to step S104. In step S104, it is determined if the AC adapter is providing power based on the output signal from the input-voltage detection circuit 23. If the result of the determation in step S104 is affirmative, the process proceeds to step S105, where it is determined if the battery is to be charged (for example, by checking if a fully charged state is provided) based on the output signal from the input-voltage detection circuit 23. If the result of the determination in step S105 is affirmative, the process proceeds to step S106, where charging and display of charging are automatically started by controlling the charging circuit 25, i.e,, the mode is switched to the charging mode or the charging mode is continued. If the result of the determination in step S105 or in step S104 is negative, the process proceeds to step S107, where charging and display of charging are interrupted or stopped, and the process returns to step S101.

In step S103, it is determined if the time after the request for recording processing has been terminated exceeds a predetermined value, i.e., if a time-out has occurred. If the result of the determination in step S103 is negative, the process returns to step S101. If the result of the determination in step S103 is affirmative, the process proceeds to step S108, where the MPU 2 performs processing of closing the cap. Then, in step S109, a capping flag is set. The above-described process of closing the cap when a time-out occurs is termed automatic capping processing, which is well-known processing for preventing the recording head from being clogged when a recording operation is not performed.

If the result of the determination in step S101 is affirmative, the process proceeds to step S110, where it is determined if the recording head is capped based on the capping flag. If the result of the determination in step S110 is negative, i.e., if the cap is opened, the process proceeds to step S115. If the result of the determination in step S110 is affirmative, the process proceeds to step S111 where it is determined if charging is being performed. If the result of the determination in step S111 is affirmative, the process proceeds to step S112, where charging and display of charging are stopped. If the result of the determination in step S111 is negative, the process proceeds to step S113, where cap opening processing is performed. After resetting the capping flag in step S114, the process proceeds to step S115, where recording processing is performed in accordance with a recording command from the host apparatus. Upon completion of the recording processing, the process returns to step S101. If a time-out occurs while waiting for the next recording command from the host apparatus, the cap is closed, and charging processing is resumed if necessary, as described above in connection with steps S102–S109.

In summing up the above-described processing, in steps S101, and S110–S115, charging processing is not performed because the printing mode is executed. In steps S101, S102, S103, S108 and S109, cap closing processing is performed when an interruption or end of the printing mode is determined. In steps S101, S102, and S104–S107, switching of the charging mode is performed.

As described above, by performing charging only when the cap is closed, it is possible to prevent charging when the motor and the recording head are being driven in recording processing, and therefore to perform automatic charging with less wasted charging time. Furthermore, since charging will occur only when the motor and recording head are not being driven, control is not influenced by noise generated by a driving current for the motor and the recording head, and accuracy in detection of a fully charged state is improved.

Although a recording command from the host apparatus is awaited in step S101 of the flowchart shown in FIG. 3, the recording command may be replaced by a self testing recording command. The flowchart is, of course, also effective for a case in which the recording command in step S101 is replaced by a request for processing in which it is necessary to temporarily open the cap, such as a command for cleaning the recording head, a command for exchanging an ink cartridge, a command for initializing the apparatus, a command for turning off electric power supply to the apparatus, or the like, and the process of step S111 is replaced by a process corresponding to the concerned command. That is, even if charging skipping control is not performed for each of the above-described driving requests for the motor or the recording head, charging skipping control can be assuredly realized by determining whether or not the cap is closed. Hence, the burden on software is small. Furthermore, since whether or not the recording head is present at a retracted position is determined based on whether or not the cap is closed, it is unnecessary to provide a dedicated sensor, and therefore the cost is not increased.

Although in the above-described embodiment, whether or not the recording head is present at a retracted position is determined based on whether or not the cap is closed, it is also possible to directly determine whether or not the recording head is present at a retracted position by providing a retracted-position sensor. In this case, the homeposition sensor 7 (shown in FIG. 1) may, for example, be used as such a sensor. The present invention may, of course, be applied to a recording apparatus other than the ink-jet recording apparatus by using the retracted-position sensor.

As described above, according to the present invention, since means for controlling a charging function based on retraction information indicating whether or not the recording head is at a retracted position is provided, it is possible to inhibit charging while the motor and the recording head are driven. It is thereby possible to automatically perform switching between recording processing and charging processing without increasing the size and the cost of the apparatus.

The present invention is particularly suitable for use in an ink-jet recording head and in a recording apparatus wherein thermal energy generated by an electrothermal transducer, a laser beam or the like is used to cause a change of state of ink that ejects or discharges the ink. This is because with these devices, a high density of picture elements and a high resolution of recording are possible.

The typical structure and the operational principle of such devices are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink)

retaining sheet or liquid passage, the driving signal being sufficient to provide a quick temperature rise beyond a nucleate boiling point, by which the thermal energy is provided by the electrothermal transducer to produce film boiling on the heating portion of the recording head, whereby a bubble can be formed in the liquid (ink) corresponding to each of driving signals. By the production, development and contraction of the bubble, the liquid (ink) is ejected through an ejection outlet to produce at least one droplet. The driving signal is preferably in the form of a pulse, because the development and contraction of the bubble can then be effected instantaneously, and therefore, the liquid (ink) can be ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for a plurality of electrothermal transducers, and to the structure disclosed in Japanese Laid-Open Patent Application No. 138461/1984 wherein an opening for absorbing pressure waves of the thermal energy is formed corresponding to the ejection portion. This is because the present invention is effective to perform the recording operation with certainty and at high efficiency regardless of the type of recording head.

In addition, the present invention is applicable to a serial type recording head wherein the recording head is fixed on the main assembly, to a replaceable chip type recording head which is connected electrically to the main apparatus and which can be supplied with ink when it is mounted in the main assembly, or to a cartridge type recording head having an integral ink container.

The provisions of the recovery means and/or the auxiliary means for the preliminary operation are preferable, because they can further stabilize the effects of the present invention. Examples of such means include capping means for the recording head, cleaning means there-for, pressing or suction means, and preliminary heating means which may be the electrothermal transducer, an additional heating element or a combination thereof. Also, means for effecting preliminary ejection (not for the recording operation) can stabilize the recording operation.

Variations of the recording head mounting may include a single head corresponding to a single color ink, or a plurality of heads corresponding to a plurality of ink materials having different recording colors or densities. The present invention may also be effectively applied to an apparatus having at least one of a monochromatic mode mainly with black, a multicolor mode with different color ink materials, a full-color mode using the mixture of colors, which may be an integrally formed recording unit or a combination of a plurality of recording heads.

Furthermore, while the foregoing describes the use of liquid ink, an ink material which is solid below room temperature but liquid at room temperature may also be used. Since the ink in this type of recording apparatus is preferably kept within a temperature range between 30° C. and 70° C., in order to stabilize the viscosity of the ink to provide stabilized ejection, the ink may be such that it is liquid within the temperature range when the recording signal in the present invention is applied. With one type of ink, the temperature rise due to the thermal energy is positively prevented by consuming it for the state change of the ink from the solid state to the liquid state. Another type of ink material is solidified when it is left, to prevent the evaporation of the ink. In either of the cases, in response to the application of the recording signal producing thermal energy, the ink is liquefied, and the liquefied ink may be ejected. Another ink material may start to be solidified at the time when it reaches the recording material.

The present invention is also applicable to such an ink material as is liquefied by the application of thermal energy. Such an ink material may be retained as a liquid or solid material in through holes or recesses formed in a porous sheet as disclosed in Japanese Laid-Open Patent Application Nos. 56847/1979 and 71260/1985. The sheet is faced to the electrothermal transducers. The most effective one of the techniques described above is the film boiling system.

The ink-jet recording apparatus may be used as an output terminal of an information processing apparatus such as a computer or the like, as a copying apparatus combined with an image reader or the like, or as a facsimile machine having information sending and receiving functions.

The individual components designated by blocks in the drawings are all well-known in the recording apparatus and charging method arts and their specific construction and operation are not critical to the operation or the best mode for carrying out the invention.

While the invention has been described with reference to the structures disclosed herein, it is not confined to the details set forth herein, and this application is intended to cover such modifications or changes as may come within the purposes of the improvements or the scope of the following claims.

What is claimed is:

1. A recording apparatus for performing recording by driving a recording head using electric power supplied from an external power supply or a battery, said recording apparatus comprising:

a charging circuit for charging the battery using the electric power supplied from the external power supply;

cap detection means for detecting the capping state of the recording head and generating cap information indicating the detected capping state; and control means for controlling said charging circuit based on the cap information.

2. A recording apparatus according to claim 1, wherein the recording head performs recording by discharging ink from discharging ports.

3. A recording apparatus according to claim 2, wherein a cap for capping the discharging ports of the recording head is provided at a retracted position.

4. A recording apparatus according to claim 3, wherein the cap information indicates whether or not the recording head is capped by the cap.

5. A recording apparatus according to claim 1, wherein said control means causes said charging circuit to perform charging when the cap information indicates that the recording head is capped.

6. A recording apparatus according to claim 1, wherein said control means stops charging by said charging circuit before the recording head is uncapped.

7. A method of charging a recording apparatus which performs recording by driving a recording head using electric power supplied by an external power supply or a battery, and which includes a charging circuit for charging the battery using the electric power supplied from the external power supply, said method comprising:

a detecting step of detecting whether or not the recording head is capped; and a control step of controlling the charging circuit based on a result from said detecting step.

8. A method according to claim 7, wherein the recording head performs recording by discharging ink from discharging ports, a cap for capping the discharging ports of the recording head is provided at the retracted position, and wherein the step of detecting whether or not the recording head is at the retracted position comprises the step of detecting whether or not the recording head is capped by the cap.

9. A method according to claim 8, wherein said control step causes the charging circuit to perform charging when the result from said detecting step indicates that the recording head is capped.

10. A method according to claim 8, wherein said control step stops charging by the charging circuit when the recording head is uncapped.

11. A recording apparatus comprising:

a recording head;

a power supply circuit capable of supplying power to the recording apparatus when external power is provided to said power supply, and capable of supplying power to the recording apparatus when power is provided to said power supply from a battery;

a detector that detects the capping state of the recording head and generates cap information indicating the detected capping state; and a charging circuit that charges the battery from the external power based on the cap information.

12. The recording apparatus according to claim 11, wherein said charging circuit also inhibits charging of the battery when the battery is fully charged.

13. A recording apparatus according to claim 11, wherein said charging circuit charges the battery when the cap information indicates that said recording head is capped.

* * * * *

UNITED STATES PATENT AND TRADEMARK OFFICE

CERTIFICATE OF CORRECTION

PATENT NO. : 6,412,900 B2
DATED : July 2, 2002
INVENTOR(S) : Horigome

It is certified that error appears in the above-identified patent and that said Letters Patent is hereby corrected as shown below:

Column 1,
Line 26, “small-size” should read -- small-sized --.

Column 4,
Line 47, “port 01” should read -- port $O_1$ --;
Line 50, “VH” should read -- $V_H$ --;
Line 52, “an” should read -- a --;
Line 54, “voltage Vpp” should read -- $V_{PP}$ --; and
Line 57, “port O2” should read -- port $O_2$ --.

Column 5,
Line 15, “determation” should read -- determination --.

Column 6,
Line 14, “self testing” should read -- self-testing --; and
Line 38, “homeposition” should read -- home-position --.

Column 7,
Line 46, “there-for,” should read -- therefore, --.

Column 9,
Line 10, “a” should read -- the --.

Column 10,
Line 2, “when” should read -- before --.

Signed and Sealed this

Eighteenth Day of March, 2003

JAMES E. ROGAN
*Director of the United States Patent and Trademark Office*